US005277351A

United States Patent [19]

McCullagh

[11] Patent Number: 5,277,351

[45] Date of Patent: Jan. 11, 1994

[54] SHEET WRAPPING DISPENSER APPARATUS

[76] Inventor: William C. McCullagh, 285 Orchard Dr., Kenmore, N.Y. 14223

[21] Appl. No.: 952,321

[22] Filed: Sep. 28, 1992

[51] Int. Cl.[5] ..... B65H 35/06

[52] U.S. Cl. ..... 225/38; 225/47; 225/77

[58] Field of Search ..... 225/37, 38, 42, 46, 225/47, 77

[56] References Cited

U.S. PATENT DOCUMENTS

| | | | |
|---|---|---|---|
| 350,808 | 10/1886 | Cole | 225/90 |
| 1,981,013 | 11/1934 | Wegener | 225/77 |
| 2,815,906 | 12/1957 | Hofmeier | 225/38 |
| 2,969,169 | 1/1961 | Botnick | 225/51 |
| 3,529,504 | 9/1970 | Hagerty et al. | 225/47 |
| 4,762,259 | 8/1988 | Kosa | 225/37 |
| 4,817,840 | 4/1989 | Atkins et al. | 225/38 |
| 5,172,841 | 12/1992 | Friedman | 225/42 |

FOREIGN PATENT DOCUMENTS

| | | | |
|---|---|---|---|
| 23473 | 2/1981 | European Pat. Off. | 225/77 |
| 11641 | of 1890 | United Kingdom | 225/51 |

*Primary Examiner*—Hien H. Phan

*Attorney, Agent, or Firm*—Leon Gilden

[57] ABSTRACT

A sheet wrapping dispenser is arranged to support rotatively a roll of wrapping web material oriented for ease of severance and mounting of the organization relative to the support structure.

1 Claim, 4 Drawing Sheets

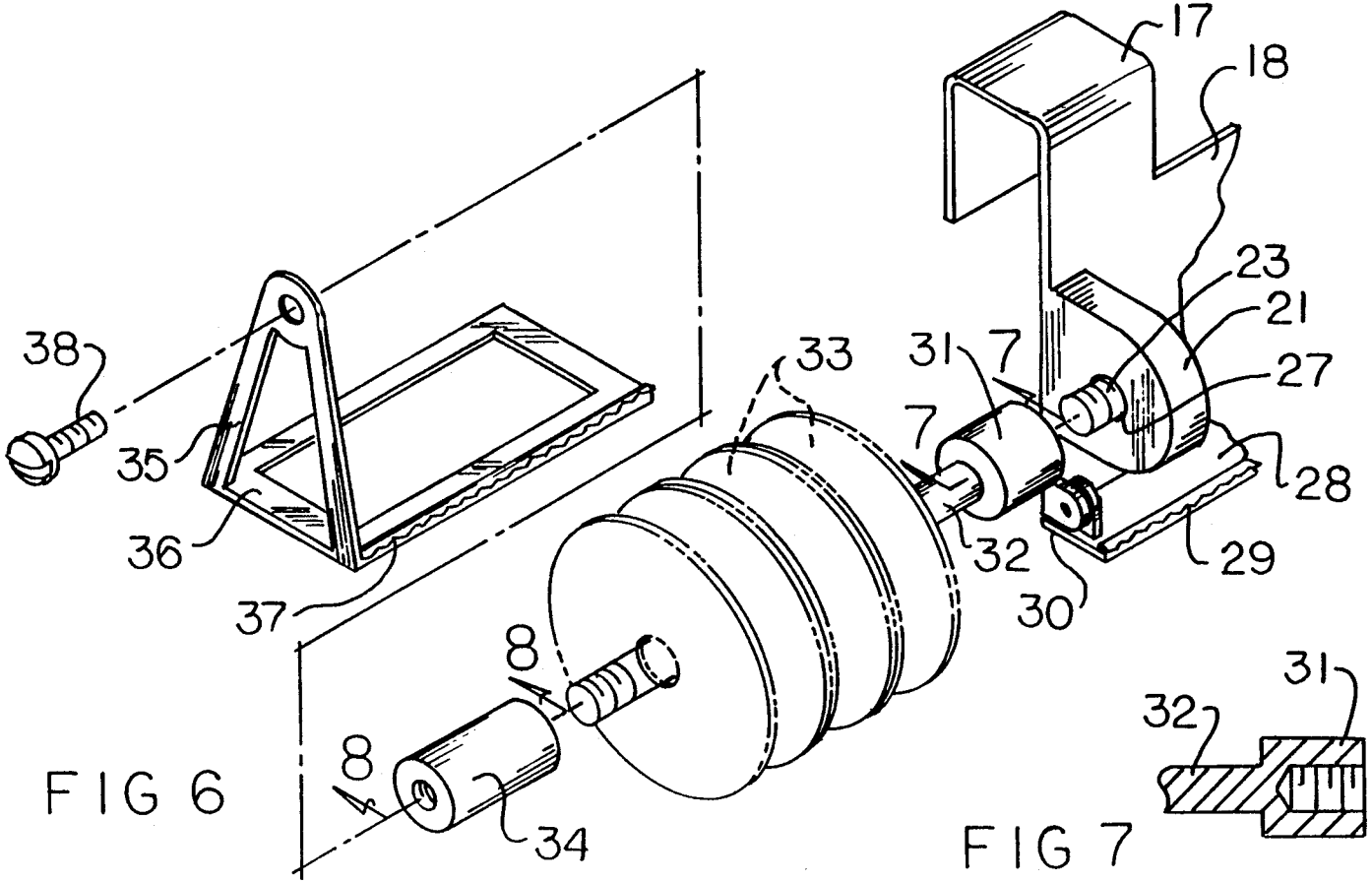
FIG 6
FIG 7
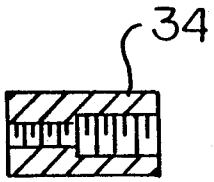
FIG 8

SHEET WRAPPING DISPENSER APPARATUS

BACKGROUND OF THE INVENTION

1. Field of the Invention

The field of invention relates to sheet dispensing apparatus, and more particularly pertains to a new and improved sheet wrapping dispenser apparatus wherein the same is arranged for the ease of mounting and dispensing of wrapping material from a web roll.

2. Description of the Prior Art

The dispensing and presentation of various sheet and film wrapping structure has been available in the prior art as exemplified by U.S. Pat. Nos. 4,166,589; 3,716,964; 3,477,656; and 3,516,615.

Accordingly, it may be appreciated there continues to be a need for a new and improved sheet wrapping dispenser apparatus as set forth by the instant invention which addresses both the problems of ease of use as well as effectiveness in construction in the mounting and presentation of sheet webbing to be dispensed and in this respect, the present invention substantially fulfills this need.

SUMMARY OF THE INVENTION

In view of the foregoing disadvantages inherent in the known types of dispensing and tearing apparatus now present in the prior art, the present invention provides a sheet wrapping dispenser apparatus wherein the same is arranged for the mounting and dispensing and associated tearing of a web material for wrapping purposes of gifts and the like. As such, the general purpose of the present invention, which will be described subsequently in greater detail, is to provide a new and improved sheet wrapping dispenser apparatus which has all the advantages of the prior art dispensing and tearing apparatus and none of the disadvantages.

To attain this, the present invention provides a sheet wrapping dispenser arranged to support rotatively a roll of warpping web material oriented for ease of severance and mounting of the organization relative to the support structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sheet wrapping dispenser apparatus which has all the advantages of the prior art dispensing and tearing apparatus and none of the disadvantages.

It is another object of the present invention to provide a new and improved sheet wrapping dispenser apparatus which may be easily and efficiently manufactured and marketed.

It is a further object of the present invention to provide a new and improved sheet wrapping dispenser apparatus which is of a durable and reliable construction.

An even further object of the present invention is to provide a new and improved sheet wrapping dispenser apparatus which is susceptible of a low cost of manufacture with regard to both materials and labor, and which accordingly is then susceptible of low prices of sale to the consuming public, thereby making such sheet wrapping dispenser apparatus economically available to the buying public.

Still yet another object of the present invention is to provide a new and improved sheet wrapping dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a ribbon dispensing assembly mounted to the organization of FIG. 4.

FIG. 7 is an orthographic view, taken along the lines 7—7 of FIG. 6.

FIG. 8 is an orthographic view, taken along the lines 8—8 of FIG. 6 in the direction indicated by the arrows.

DESCRIPTION OF THE PREFERRED EMBODIMENT

Figure 2:
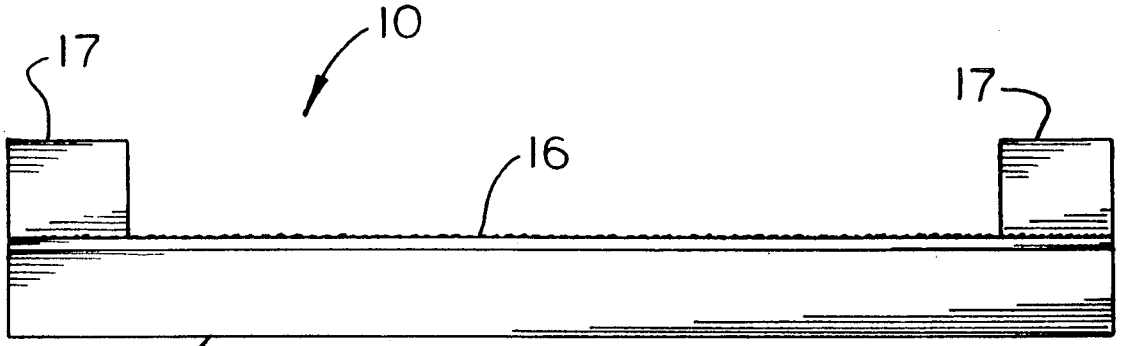
FIG. 2 is an orthographic frontal view of the invention.

With reference now to the drawings, and in particular to FIGS. 1 to 9 thereof, a new and improved sheet wrapping dispenser apparatus embodying the principles and concepts of the present invention and generally designated by the reference numeral 10 will be described.

Figure 3:
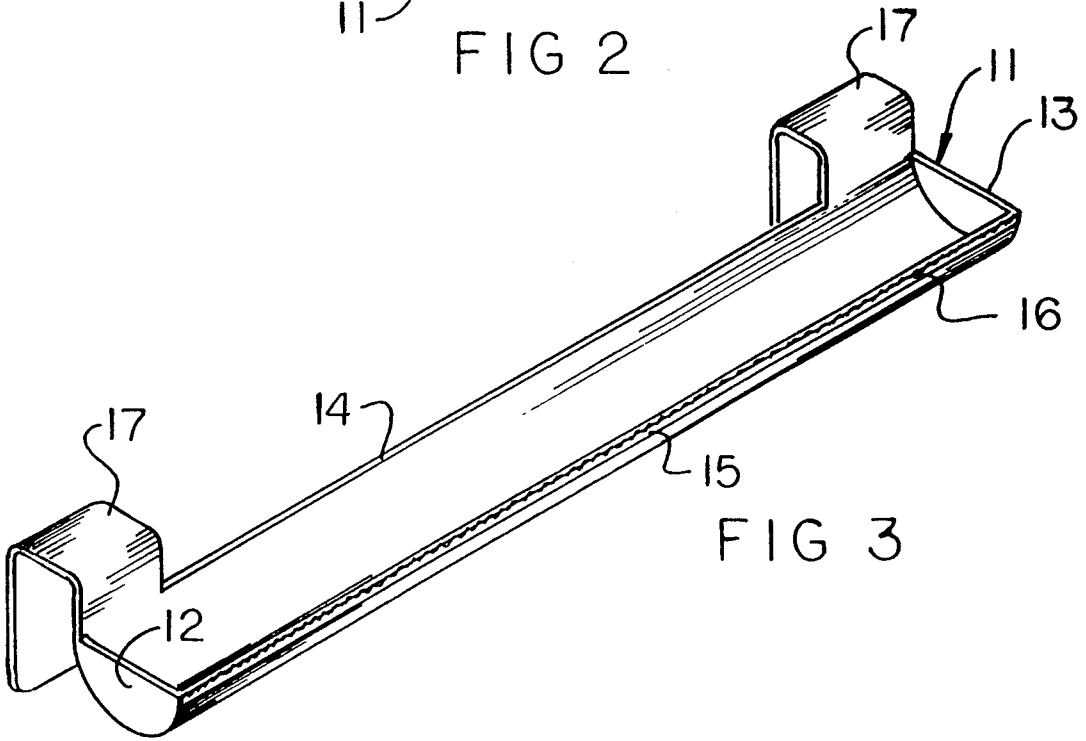
FIG. 3 is an isometric illustration of the invention.
Figure 1:
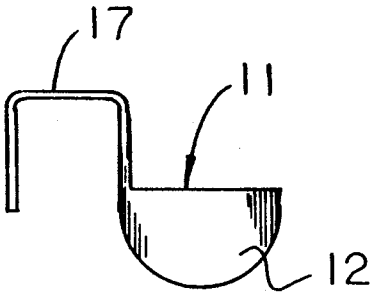
FIG. 1 is an orthographic side view of the instant invention.

More specifically, the sheet wrapping dispenser apparatus 10 of the instant invention, as indicated in FIGS. 1–3, includes a semi-cylindrical trough 11 having a first end wall 12 spaced from and parallel a second end wall 13. A first side edge 14 is arranged parallel and coextensive with a second side edge 15, with the first side edge 14 having a plurality of U-shaped hook members 17 extending therefrom and oriented and directed rearwardly of the first side edge 14, in a manner as indicated in FIG. 1. A serrated cutter bar 16 is positioned coextensively with the second side edge 13 to permit the subsequent severing and removal of a web of wrapping material of conventional configuration, such as indicated in the U.S. Pat. Nos. 4,166,589 or 3,716,964 incorporated herein by reference.

In this manner, the organization is arranged for ease of mounting relative to an associated and convenient support structure, such as a door, a chair, and the like, with a roll of web material readily placed within the semi-cylindrical trough structure 11 between the first and second end walls. Portability, unitary construction, and ease of manipulation in use indicate advantageous construction of the instant invention.

Figure 4:
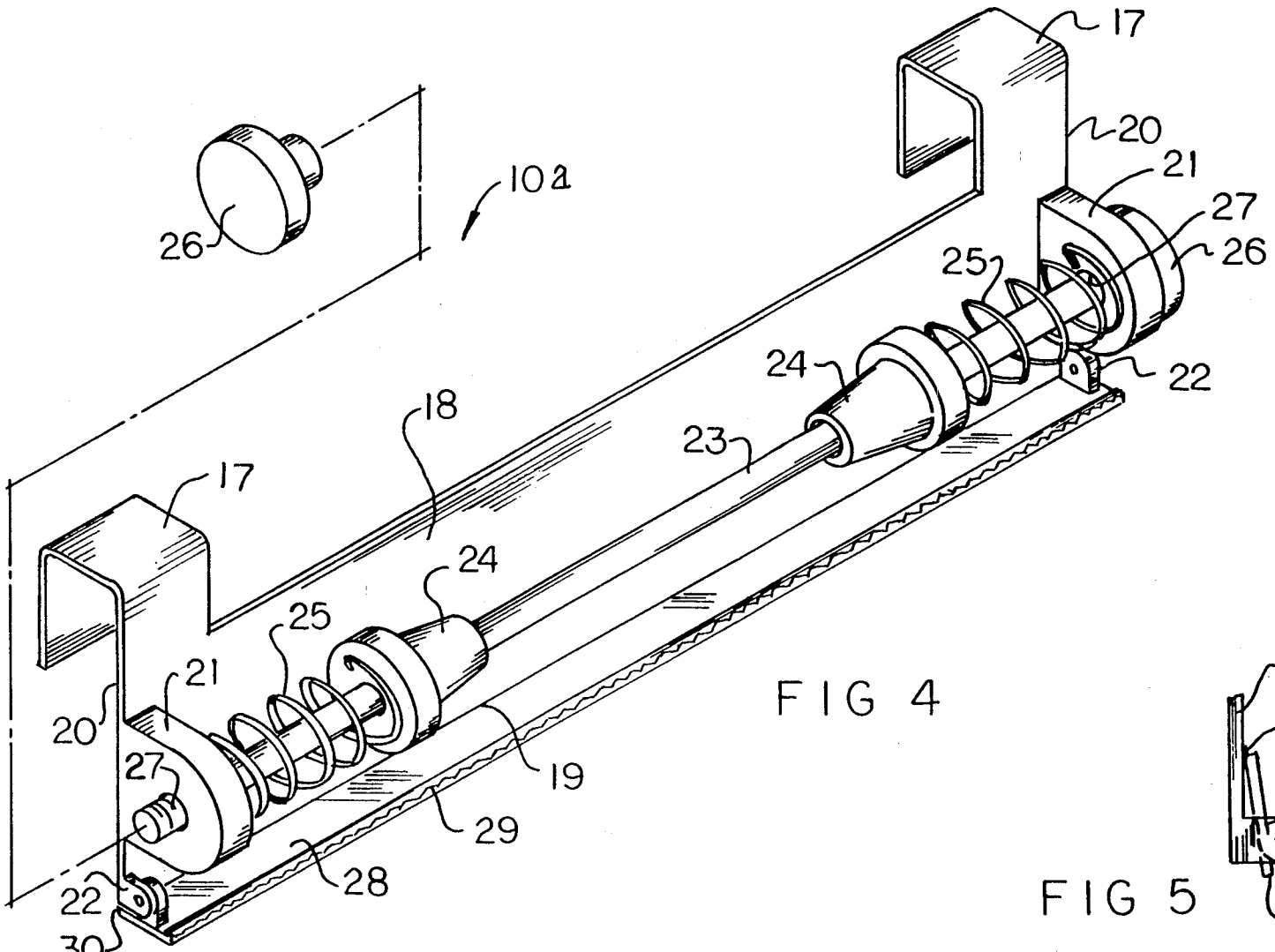
FIG. 4 is an isometric illustration of a modified configuration of the invention.
Figure 5:
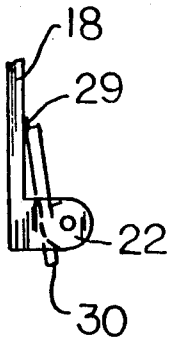
FIG. 5 is an orthographic end view of the pivotal cutter bar structure of the invention, as set forth in FIG. 4.

The apparatus 10*a*, as indicated in the FIGS. 4 and 5, includes a central plate 18 having a plate lower edge 19 spaced from and parallel a plate upper edge, with the plate upper edge including the U-shaped hook member 17 extending therefrom directed rearwardly thereof, with the U-shaped hook member arranged in a parallel coextensive relationship for mounting, in a manner as indicated above, relative to the organization 10*a*. The central plate 18 further includes spaced parallel side edges 20, with first support flanges 21 arranged in a parallel and coextensive relationship relative to one another orthogonally oriented relative to the central plate 18 extending forwardly thereof to the side edges 20. Oriented below the first support flanges 21 are second support flanges 22 arranged in a parallel coextensive relationship positioned in adjacency relative to the lower edge 19 and mounted to and in adjacency of the side edges 20. A support axle 23 is directed through coaxially aligned first flange bores 27, with the support axle 23 having confronting conical plug members 24 positioned between the first support flanges 21. Each of the plug members 24 includes a spring 25 interposed between a respective plug member and an adjacent first support flange 21 to bias the plug members towards one another. Support axle caps 26 are arranged for threaded engagement to the support axle 23 as it projects exteriorly of a first support flange 21 beyond an associated side edge 20. A cutter bar 28 is pivotally mounted to the second support flanges 22 extending coextensively thereof, where the cutter bar 28 includes a cutter bar serrated forward edge 29 and a cutter bar rear edge 30 arranged for engagement with the central plate lower edge 19. During periods of storage, the cutter bar may be pivoted to a raised orientation, as indicated in FIG. 5, spacing the cutter bar rear edge 30 relative to the central plate lower edge 19 for purposes of safety.

The FIGS. 6–8 indicate the use of a ribbon support assembly for use in conjunction with the organization, wherein the assembly includes a mounting hub 31 threadedly engaged onto the support axle 23 as it projects exteriorly of one of said first support flanges 21. The mounting hub 31 has integrally secured thereto a mounting hub shaft 32 coaxially aligned with the support axle 23. Rotatably mounted upon the mounting hub shaft 32 are a plurality of ribbon rolls 33. A spacer cylinder 34 is mounted threadedly onto the mounting hub shaft 32 positioning the ribbon rolls 33 between the spacer cylinder 34 and the mounting hub 31. The spacer cylinder 34 includes a first internally threaded bore arranged for threaded engagement with the mounting hub shaft 32, with the first internally threaded bore coaxially aligned with the second internally threaded bore arranged for receiving a fastener 38. Interposed between the fastener 38 and the spacer cylinder 34 is a lock bracket 35 orthogonally oriented relative to the mounting hub shaft 32, with the lock bracket 35 having a cutter bracket 36 orthogonally oriented relative to the lock bracket, wherein the cutter bracket 36 is positioned below the mounting hub shaft 32, with the cutter bracket 36 having a cutter bracket cutter bar 37 at a forward edge thereof.

Figure 9:
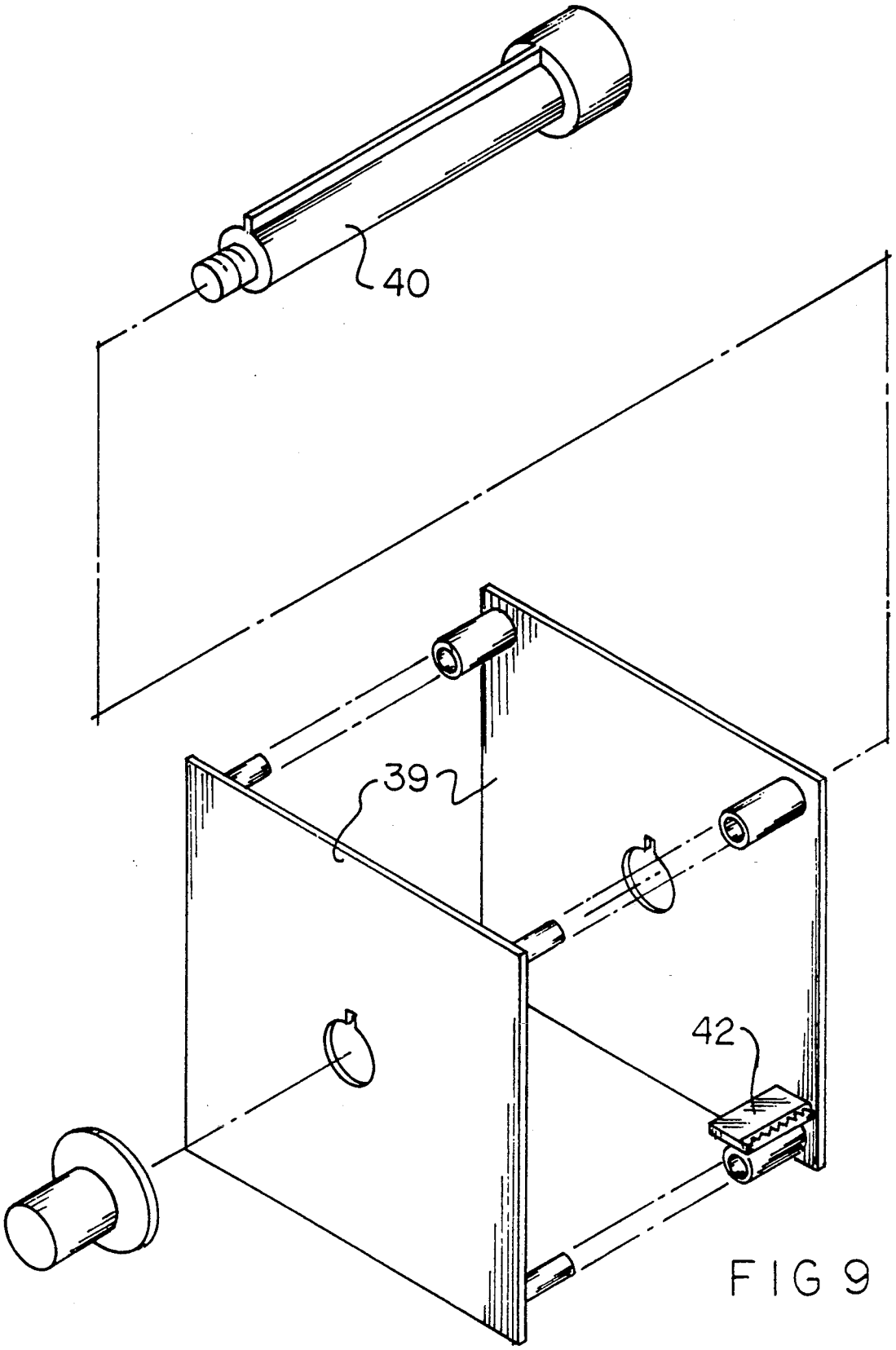
FIG. 9 is an isometric illustration of a ribbon cartridge structure for optional use by the invention, as set forth in FIG. 4.

The FIG. 9 indicates the use of a further ribbon cartridge support having spaced mounting plates 39, including a keyed mandrel 40 orthogonally and medially directed through the spaced mounting plates 39, with the keyed mandrel 40 arranged for threaded engagement with the support axle 23 in a like manner as the mounting hub 31. A plate cutter bar 42 is integrally mounted between the spaced mounting plates 39 with ribbons positioned rotatably upon the mandrel 40 for use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sheet wrapping dispenser apparatus, comprising, a central plate, the central plate having an upper edge spaced from a lower edge, with the upper edge having a plurality of U-shaped hook members mounted to the upper edge extending rearwardly of the central plate, with the U-shaped hook members arranged in a parallel coextensive relationship relative to one another, and the central plate having spaced side edges, and a plurality of first support flanges, one of said support flanges mounted to each of said side edges, wherein the first support flanges are arranged in a parallel coextensive relationship relative to one another, and the first support flanges each include a first flange bore, wherein the first flange bores are coaxially aligned, and a support axle directed through the first flange bores, the support axle projecting beyond the first support flanges and beyond the side edges, and second support flanges mounted orthogonally and fixedly to the side edges, with one of said second support flanges mounted to one of said side edges, wherein each of said second support flanges are mounted below a respective one of said first support flanges, and a cutter bar pivotally mounted to the second support flanges arranged coextensively therebetween in an orthogonal relationship, with the cutter bar having a serrated forward edge and a cutter bar rear edge, the cutter bar rear edge is arranged for engagement with the central plate lower edge in a first position and arranged for a spaced relationship relative to the central plate lower edge in a second position when the cutter bar is rotated relative to the second support flanges, with the support axle arranged for receiving a web roll, with the web roll arranged to be severed by the serrated forward edge,and the support axle includes at least one support axle cap mounted to the support axle exteriorly of one of the first support flanges, and the support axle having a plurality of conical plug members rotatably mounted to the support axle between the first support flanges, with each of said plug members including a spring interposed between each of said plug members and one of said first support flanges to bias the plug members towards one another between the first support flanges, and a mounting hub secured to the support axle exteriorly of the central plate, with the mounting hub including a mounting hub shaft integral therewith and longitudinally aligned with the mounting hub and the support axle, the mounting web arranged for receiving at least one ribbon roll rotatably thereabout, and a spacer cylinder longitudinally aligned with and secured to the mounting hub spaced from the mounting hub, with the at least one ribbon roll positioned between the spacer cylinder and the mounting hub, and the spacer cylinder having a first integrally threaded bore arranged for threaded engagement with the mounting hub shaft, and a second internally threaded bore coaxially aligned with the first internally threaded bore, with the second internally threaded bore arranged for receiving a fastener thereon, and a lock bracket mounted to the spacer cylinder between the fastener and the spacer cylinder, with the lock bracket orthogonally oriented relative to the spacer cylinder projecting below the mounting hub shaft, the lock bracket including a lock bracket cutter bracket, the lock bracket cutter bracket orthogonally oriented relative to the lock bracket and positioned below the mounting hub shaft and substantially coextensive therewith, with the lock bracket cutter bracket including a cutter bracket cutter bar at a forward edge of the cutter bracket.

* * * * *